United States Patent [19]

Trivedi et al.

[11] Patent Number: 4,989,478

[45] Date of Patent: Feb. 5, 1991

[54] TURNING APPARATUS

[76] Inventors: Arvind Trivedi, 3 Whitehall Way, Englishtown, N.J. 07726; Tadeusz Stachowiak, 48-B Juniper Plz., Cranbury, N.J. 08512

[21] Appl. No.: 374,154

[22] Filed: Jun. 30, 1989

[51] Int. Cl.[5] ..... B25B 13/00

[52] U.S. Cl. ..... 81/57.36; 81/57.32

[58] Field of Search ..... 81/55, 57.22, 57.24, 81/57.3, 57.36, 57.4

[56] References Cited

U.S. PATENT DOCUMENTS

| | | | |
|---|---|---|---|
| 369,908 | 4/1886 | Forbes | 81/55 |
| 1,312,889 | 8/1919 | Brown | 81/57.24 |
| 2,102,897 | 12/1937 | Holhut | 81/13 |
| 3,905,254 | 9/1975 | Palatnick et al. | 81/57.22 X |
| 4,063,475 | 12/1977 | Perkins | 81/57.22 |
| 4,274,310 | 6/1981 | Michaud | 81/57.36 |
| 4,335,443 | 6/1982 | Pearson | 81/55 |
| 4,387,611 | 6/1983 | Junkers | 81/57.36 |

FOREIGN PATENT DOCUMENTS 2556746 6/1977 Fed. Rep. of Germany ..... 81/57.36

*Primary Examiner*—James G. Smith

*Attorney, Agent, or Firm*—Curtis, Morris and Safford

[57] ABSTRACT

Apparatus for tightening or loosening a plurality of bolts or other rotatable elements in which a drive socket and a pair of reaction sockets are supported by an elongated beam member. The drive socket is placed on a selected rotatable element to be turned, and the reaction sockets are placed on additional rotatable elements on opposite sides of the selected element. The reaction sockets are slidable along the beam member to accommodate different distances between the rotatable elements and may be locked in place in their proper positions. During the turning movement, the beam member and the reaction sockets apply force to the additional elements in a direction opposite to the force applied to the element being turned to thereby prevent any significant movement of the additional elements and their supporting structure.

9 Claims, 5 Drawing Sheets

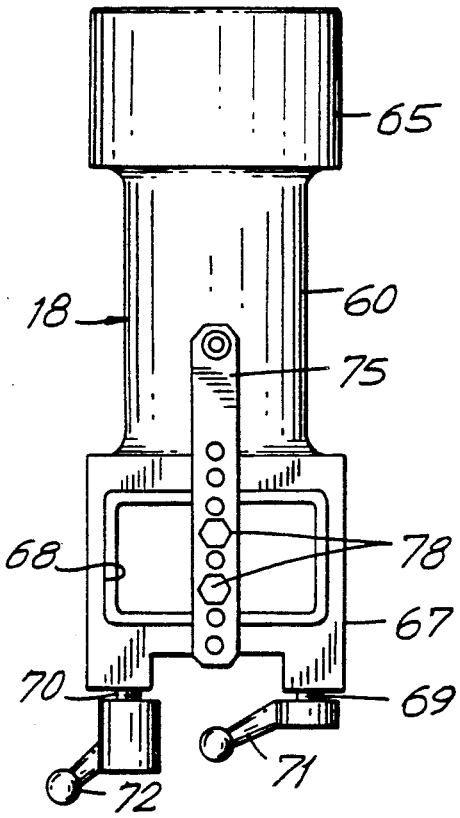
FIG. 4
FIG. 5
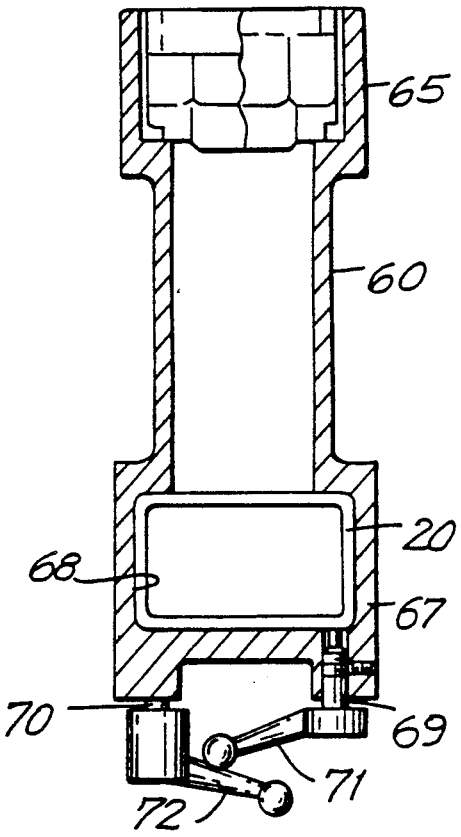

TURNING APPARATUS

BACKGROUND OF THE INVENTION

This invention relates to turning apparatus and more particularly to apparatus for turning a plurality of adjacent rotatable elements.

The present invention, while of general application, is particularly well-suited for tightening or loosening bolts and other fastening elements under high torque. Large suspension bridges, for example, utilize several thousands of bolts to hold the cable bands in place around the suspension or main cables of the bridge, and the cable bands carry the vertical suspender cables or ropes which support the roadway. Typically, each cable band is of barrel-shaped configuration and comprises two semi-cylindrical castings bolted together top and bottom with up to twenty bolts. Each of these bolts must be periodically checked and retightened to a precise load to prevent the band from slipping relative to the associated cable.

Heretofore, difficulties have been encountered in the tightening or loosening of bolts and other rotatable elements. As an illustration, the torque necessary to turn the elements often has had an adverse twisting affect on the adjacent structure. In addition, it has been difficult to tighten the elements to a precise load in order to maintain an adequate clamping force. These difficulties were of special concern in the tightening of suspension bridge cable band bolts and in other turning operations involving the application of high torque and critical clamping forces.

SUMMARY

One general object of this invention, therefore, is to provide new and improved apparatus for turning a plurality of adjacent rotatable elements.

More specifically, it is an object of the invention to provide such apparatus in which there is little or no twisting of the structure supporting the rotatable elements.

Another object of the invention is to provide turning apparatus of the character indicated in which the rotatable elements may be tightened to a precise load.

A further object of the invention is to provide turning apparatus which is economical to manufacture and thoroughly reliable in operation.

In one illustrative embodiment of the invention, the apparatus includes an elongated beam member which extends in a direction transverse to the axis of rotation of at least one of the rotatable elements to be turned. A drive socket is mounted on the beam member in position to engage the one rotatable element, and a hydraulic wrench is utilized to rotate the drive socket to thereby turn the rotational element.

In accordance with one feature of this invention, in certain particularly important embodiments, two post assemblies are supported by the beam member on opposite sides of the drive socket. Each of these assemblies includes a reaction socket which is movable into engagement with an additional rotatable element adjacent the element to be turned. During the rotational movement of the drive socket in a given direction, the reaction sockets apply force to the additional rotational elements in the opposite direction to prevent any significant movement of the additional elements. The arrangement is such that twisting or other movement of the structure supporting the additional elements likewise is prevented as the drive socket rotates.

In accordance with another feature of certain embodiments of the invention, the posts supporting the reaction sockets are slidably mounted on the reaction beam but may be rigidly locked to the beam when the sockets carried by the posts are in engagement with the additional rotational elements. With this arrangement, the apparatus may be readily adjusted to accommodate varying distances between the elements.

The present invention, as well as further objects and features thereof, will be more fully understood from the following description of a preferred embodiment, when read with reference to the accompanying drawings.

BRIEF DESCRIPTION OF THE DRAWINGS

FIG. 4 is a side elevational view of the turning apparatus.

FIGS. 5 is a sectional view taken along the line 5—5 in FIG. 2.

FIG. 6 is a sectional view taken along the line 6—6 in FIG. 2.

DESCRIPTION OF A PREFERRED EMBODIMENT

Figure 1:
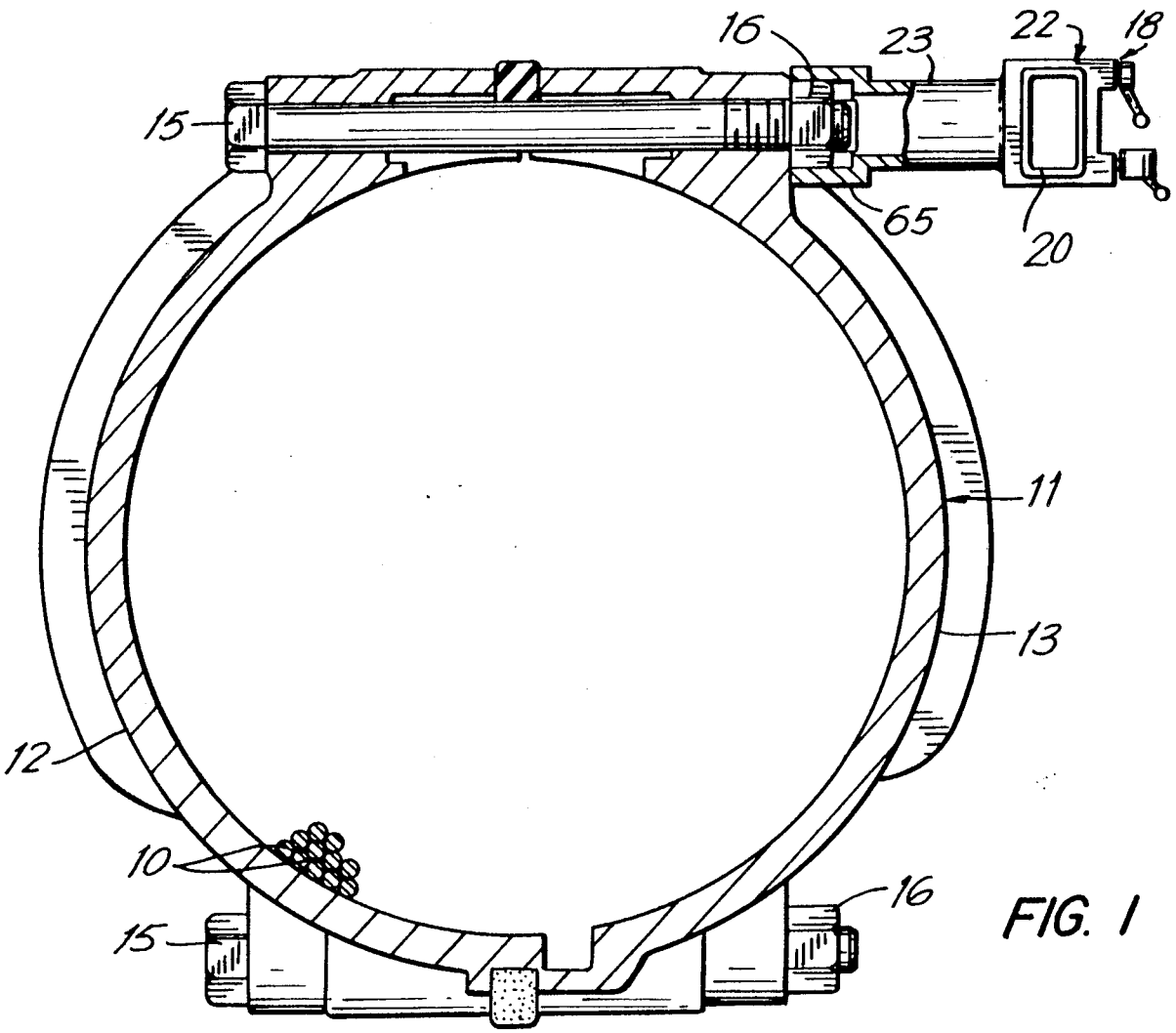
FIG. 1 is a vertical cross-sectional view of a typical bridge suspension cable and cable band, together with bolt turning apparatus in accordance with an illustrative embodiment of the invention.

Referring to FIG. 1 of the drawings, there is shown a bridge suspension cable assembly which comprises a multiplicity of cables 10 which are bundled together in conventional fashion. Surrounding the cable assembly is a barrel-shaped cable band 11. The band 11 is formed from two semi-cylindrical castings 12 and 13 which are held together by cable band bolts 15 and cooperating nuts 16. The bolts 15 illustratively have a diameter of 2 $\frac{3}{8}$ inches and a length of about 29 inches.

Typical suspension bridges utilize large numbers of the cable bands to support the vertical suspender cables for the bridge. The primary function of the bands 11 is to prevent the vertical cables from sliding down the suspension cable 10, and for this reason it is imperative that the bolts 15 maintain an adequate clamping force. This force, which may be of the order of 100,000 pounds, is provided by up to twenty of the bolts 15 for each cable band. To insure that the cable bands remain in their proper positions on the suspension cable, each bolt must be periodically checked and retightened to the specified clamping force. The bolts on a given cable band are located in two rows with the bolts in each row adjacent to one another with their axes in a common plane and spaced in parallel relationship. It is important that the bolt axes and the cable bands and other supporting structure remain stationary during the checking and retightening operation.

The checking and retightening of the cable band bolts 15 is accomplished through the use of turning apparatus indicated generally at 18. The apparatus 18 includes an elongated reaction beam 20 of rectangular cross-section which is oriented in a direction transverse to the axes of the bolts. This beam illustratively has a length of six feet and is provided at its approximate midpoint with a retaining member 22 which supports a drive bar 23.

As best shown in FIG. 6, the retaining member 22 includes a wrench bracket 25 which is rigidly affixed to the reaction beam 20. The bracket 25 is provided with a cylindrical opening 27 having suitable roller bearings 28 which surround the drive bar 23. A retaining plate 30 also surrounds the drive bar 23 and is affixed to the upper face of the bracket 25, as viewed in FIG. 6, by cap screws 31. A second plate 34 similarly is affixed to the opposite face of the bracket 25 by screws 35. This latter plate includes a cylindrical opening 36 and roller bearings 37 which accommodate the drive bar 23.

The drive bar 23 extends through the opening 36 in the plate 34, and its protruding end 40 is shaped to receive a hydraulic wrench shown schematically at 45. The wrench 45 is of conventional construction and illustratively has the capability of producing 10,000 ft.-lbs. of torque. Lugs 47 and 48 on the wrench 45 extend into mating apertures 49 and 50 in the plate 34, and these lugs together with a retaining cap 52 serve to hold the wrench in position relative to the retaining member 22. The retaining cap 52 is rotatably secured to the protruding end 40 by a shoulder screw 53, and a retractable plunger 54 acts as a locking device to maintain the retaining cap and hence the hydraulic wrench in position.

Figure 2:
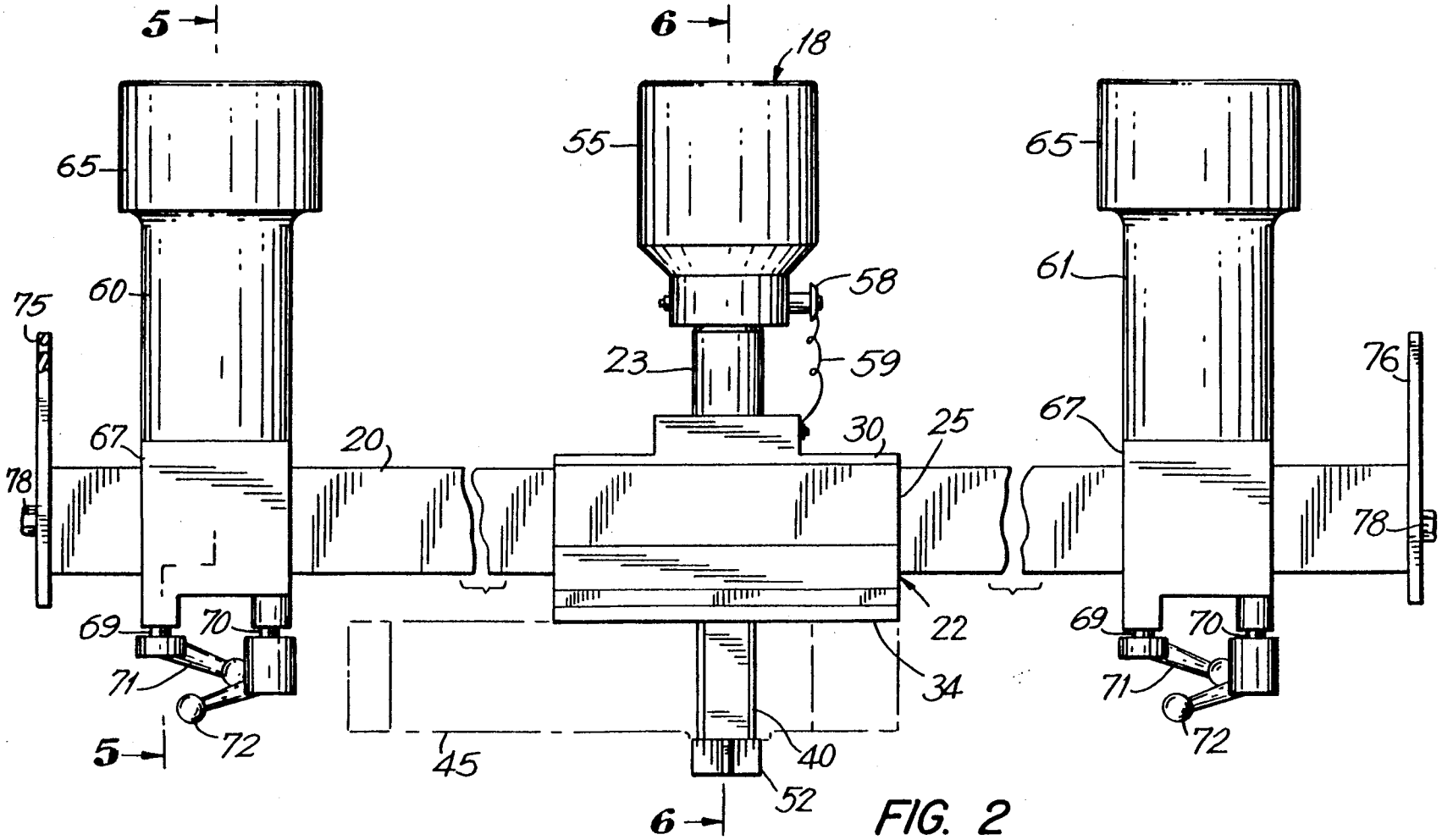
FIG. 2 is a top plan view of the turning apparatus of FIG. 1.
Figure 3:
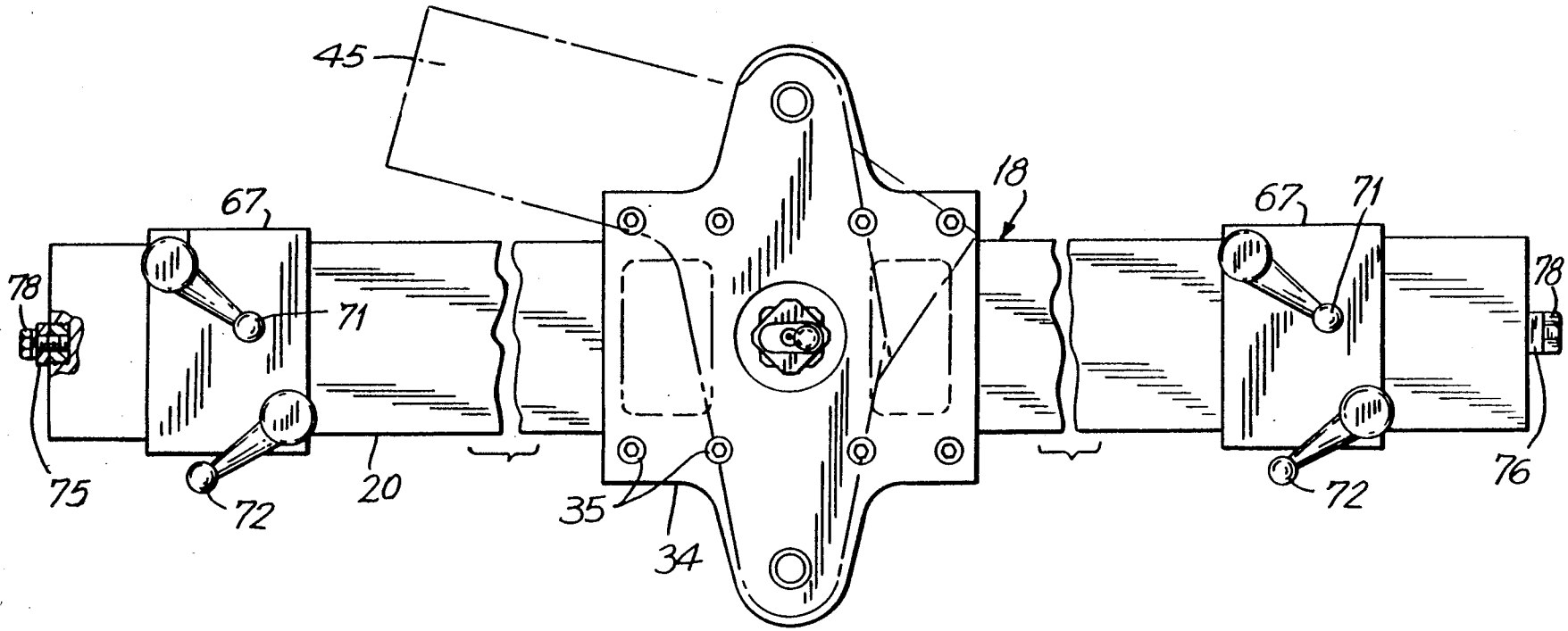
FIG. 3 is a front elevational view of the turning apparatus.

The opposite end (the upper end as viewed in FIG. 6) of the drive bar 23 is provided with a removable drive socket 55. The drive bar 23 extends into a suitable aperture 57 in the drive socket 55 and is held in place by a lock pin 58. The pin 58 is attached to the retaining member 22 by a cord 59 (FIG. 2) to prevent the pin from becoming misplaced. The drive socket 55 is of thin-wall construction and is shaped to receive one of the nuts 16 for the cable band bolts 15.

Slidably supported on the reaction beam 20 on opposite sides of the drive socket 55 are two reaction posts 60 and 61. Each of the posts 60 and 61 is provided with an integrally formed reaction socket 65, and the sockets 65 are shaped to receive the nuts 16 on either side of the nut to be turned by the drive socket 55.

Also integrally formed with each reaction post 60 and 61 is a base portion 67. As best seen in FIGS. 4 and 5, the base portion 67 includes a rectangular central opening 68 which receives the reaction beam 20. Each base portion is free to slide along the reaction beam but may be locked in place by set screws 69 and 70 and corresponding knobs 71 and 72. The opposite ends of the reaction beam 20 are provided with counterbalance brackets 75 and 76, respectively, which are held in place by cap screws 78.

To adjust the tightness of the bolts 15, the existing preload on a selected bolt is first measured. One way of conveniently accomplishing such measurement is through the use of an ultrasonic transducer available commercially from Raymond Engineering Co., Middletown, Connecticut, and identified by the trademark "Boltmaster." The transducer is magnetically attached to the head of the bolt, and a reading is taken of the bolt length. This reading is then converted to preload tension.

To initiate the turning operation, the reaction beam 20 is oriented in a direction transverse to the axes of rotation of, say, the upper row of cable band bolts 15, and the drive socket 55 is placed over the nut 16 for the selected bolt. The posts 60 and 61 are moved along the reaction beam 20 to position the corresponding reaction sockets over the nuts for the two bolts on either side of the selected bolt. The set screws 69 and 70 are then tightened through the use of the knobs 71 and 72 to hold the sockets 65 in their proper positions relative to the beam 20.

The hydraulic wrench 45 is placed in position on the protruding end 40 of the drive bar 23. The wrench 45 is operated in a direction to loosen the nut 16 within the drive socket 55, and during this loosening movement the ultrasonic transducer provides a continuous readout of the changing length of the bolt. At the time the measured elongation shows that there no longer is any load on the bolt, the nut is unscrewed, either through continued operation of the wrench or by hand, and the bolt is removed from the cable band.

If the removed bolt is in good condition, it may be cleaned and reused, or a new bolt may be inserted in its place. The nut is tightened onto the bolt by operating the hydraulic wrench 45 in the reverse direction to turn the drive socket 55. During this tightening movement the ultrasonic transducer provides precise measurements of the elongation of the bolt and hence the bolt load. When the load reaches the required load of, say, 100,000 pounds, the operation of the wrench is arrested, and the wrench and the turning apparatus 18 are disconnected and moved to a new location in preparation for the loosening and tightening of an adjacent bolt.

During both the loosening and tightening operation for a given bolt, the reaction sockets 65 on the reaction beam 20 remain in position on the two adjacent nuts on either side of the nut being turned. The sockets 65 and the beam 20 serve to apply force in a direction opposite to that applied to the turning nut, with the result that any significant twisting movement of the adjacent nuts and the cable band or other supporting structure is prevented. This oppositely directed force exactly compensates for the force applied to the turning nut through the drive socket 55, and the ultrasonic transducer provides an extremely accurate measurement of the tensile load on the bolt for the nut being turned. At the point at which this load reaches the design load, the operation of the hydraulic wrench is arrested, and the procedure is repeated for the remaining bolts and nuts.

Although the invention has been described and illustrated as having particular utility in the turning of cable band bolts for bridge structures, it also may be used with good effect to turn various different types of fastening devices and other rotatable elements. The application of force to the rotatable elements in a direction opposite to the force applied to the element being turned serves to avoid damage or injury to the supporting structure and has other important advantages.

The terms and expressions that have been employed are used as terms of description and not of limitation, and there is no intention in the use of such terms or expressions of excluding any equivalents of the features shown and described or portions thereof. Although an illustrative embodiment of the invention has been described with reference to the accompanying drawings, it is to be understood that various changes and modifications can be made without departing from the scope or spirit of the invention.

I claim:

1. Apparatus for turning a plurality of adjacent rotatable elements carried by a supporting structure, the apparatus comprising, in combination:

an elongated beam extending in a direction transverse to the axis of rotation of a selected rotatable element to be turned;

means including a drive member mounted on the beam in position to engage said selected rotatable element;

post means including at least one reaction member slidably supported for movement along the beam to and from a location intermediate the ends of the beam, and for movement into engagement with an additional rotatable element; and means for rotating said drive member in a given direction to thereby turn said selected rotatable element, said beam and said reaction member applying force to said additional rotatable element in the opposite direction during the turning of said selected rotatable element to prevent any significant movement of said additional element and said supporting structure.

2. Apparatus for turning a plurality of adjacent rotatable elements carried by a supporting structure, the apparatus comprising, in combination:

an elongated bean extending in a direction transverse to the axis of rotation of a selected rotatable element to be turned;

means including a drive socket mounted on the beam in position to engage said selected rotatable element;

post means including at least one reaction socket slidably supported for movement along the beam to and from a location intermediate the ends of the beam, and for movement into engagement with an additional rotatable element; and means for rotating said drive socket in a given direction to thereby turn said selected rotatable element, said beam and said reaction socket applying force to said additional rotatable element in the opposite direction during the turning of said selected rotatable element and said supporting structure.

3. Apparatus for turning a plurality of adjacent rotatable elements carried by a supporting structure, the apparatus comprising, in combination:

an elongated beam extending in a direction transverse to the axis of rotation of at least one of the rotatable elements;

means including a drive member mounted on the beam in position to engage said one rotatable element;

post means including a pair of reaction members slidably supported for movement along the beam to and from a location intermediate the ends of the beam, and for movement into engagement with respective additional rotatable elements; and means for rotating said drive member in a given direction to thereby turn said one rotatable element, said beam and said reaction members applying force to said additional rotatable elements in the opposite direction during the turning of said one rotatable element to prevent any significant movement of said additional elements and said supporting structure.

4. Apparatus for turning a plurality of adjacent rotatable elements carried by a supporting structure, the apparatus comprising, in combination:

an elongated beam member extending in a direction transverse to the axis of rotation of at least one of the rotatable elements;

means including a drive socket mounted on the beam member in position to engage said one rotatable element;

post means including a pair of reaction sockets slidably supported for movement along the beam member to and from a location intermediate the ends of the beam member, and in spaced relationship with the drive socket for movement into engagement with respective additional rotatable elements; and means for rotating said drive socket in a drive direction to thereby turn said one rotatable element, said beam member and said reaction sockets applying force to said additional rotatable elements in the opposite direction during the turning of said one rotatable element to prevent any significant movement of said additional elements and said supporting structure.

5. Apparatus as defined by claim 4, in which said beam member extends in a direction perpendicular to the axes of rotation of all of the rotatable elements to be turned.

6. Apparatus for turning a plurality of adjacent rotatable elements carried by a supporting structure, the apparatus comprising, in combination:

an elongated beam extending is a direction transverse to the axis of rotation of a selected rotatable element to be turned;

means including a drive member mounted on the beam in position to engage said selected rotatable element;

post means including a pair of reaction members slidably supported for movement along the beam to and from a location intermediate the ends of the beam, and on opposite sides of the drive member for movement into engagement with respective additional rotatable elements;

means for locking said post means to said beam with the reaction member in engagement with their corresponding additional rotatable elements; and means for rotating said drive member in a given direction to thereby turn said selected rotatable element, said beam and said reaction members applying force to said additional rotatable elements in the opposite direction during the turning of said selected rotatable element to prevent any significant movement of said additional elements and said supporting structure.

7. Apparatus for turning a plurality of adjacent rotatable elements carried by supporting structure, the apparatus comprising, in combination:

an elongated beam member extending in a direction transverse to the axis of rotation of at least one of the rotatable elements;

means including a thin-walled drive socket mounted on the beam member in position to engage said one rotatable element;

post means including a pair of reaction sockets slidably supported for movement along the beam member to and from a location intermediate the ends of the beam member, and on opposite sides of the drive socket for movement into engagement with respective additional rotatable elements;

means for locking said post means to said beam member with the reaction sockets in engagement with their corresponding additional rotatable elements; and means for rotating said drive socket in a given direction to thereby turn said one rotatable element, said beam member and said reaction sockets applying force to said additional rotatable elements in a direction opposite to said given direction during the turning of said one rotatable element to prevent any significant movement of said additional elements and said supporting structure.

8. Apparatus for turning the nuts of a plurality of adjacent bolts carried by a supporting structure, the apparatus comprising, in combination:

an elongated beam member extending in a direction transverse to the axis of rotation of a selected nut to be turned;

means including a drive socket mounted on the beam member in position to engage said selected nut;

post means including a pair of reaction sockets slidably supported for movement along the beam member to and from a location intermediate the ends of the beam member, and on opposite sides of the drive socket for movement into engagement with respective additional nuts;

means for locking said post means to said beam member with the reaction sockets in engagement with their corresponding nuts; and means for rotating said drive socket in a given direction to thereby turn said one nut, said beam member and said reaction sockets applying force to said additional nuts in a direction opposite to said given direction during the turning of said selected nut to prevent any significant movement of said additional nuts and said supporting structure.

9. Apparatus as defined by claim 8, in which the beam member extends in a direction perpendicular to the axes of rotation of all of the rotatable element to be turned.

* * * * *